US007132919B2

(12) United States Patent
Neumann et al.

(10) Patent No.: US 7,132,919 B2
(45) Date of Patent: Nov. 7, 2006

(54) HIGH-FREQUENCY INDUCTOR WITH INTEGRATED CONTACT

(75) Inventors: Michael J. Neumann, Milwaukee, WI (US); Roger L Valentine, Santa Rosa, CA (US); Fred H. Hoppe, Santa Rosa, CA (US); Andrew C. Duckhorn, Forestville, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 85 days.

(21) Appl. No.: 10/698,562

(22) Filed: Oct. 30, 2003

(65) Prior Publication Data

US 2005/0093670 A1 May 5, 2005

(51) Int. Cl.
*H01F 27/29* (2006.01)

(52) U.S. Cl. ..... 336/192

(58) Field of Classification Search ..... 336/65, 336/83, 192, 198, 199–208, 225, 231–233, 336/220–223; 33/181, 185; 333/181, 185
See application file for complete search history.

(56) References Cited

U.S. PATENT DOCUMENTS

| | | | | |
|---|---|---|---|---|
| 1,727,932 | A | 9/1929 | Medved | |
| 2,255,730 | A | 9/1941 | Frazier | |
| 2,351,604 | A | 6/1944 | Ferrill | |
| 2,442,776 | A | 6/1948 | Newkirk | |
| 2,547,412 | A | 4/1951 | Salisbury | |
| 3,812,438 | A | 5/1974 | Hopfer | |
| 4,087,791 | A | 5/1978 | Lemberger | |
| 4,236,127 | A | 11/1980 | Scherba | |
| 4,343,029 | A | 8/1982 | Renga et al. | |
| 4,429,314 | A | 1/1984 | Albright | |
| 4,543,208 | A | 9/1985 | Horie et al. | |
| 4,893,105 | A | 1/1990 | Maeda et al. | |
| 4,947,065 | A | 8/1990 | Ward et al. | |
| 5,321,965 | A | 6/1994 | Baird | |
| 5,679,402 | A | 10/1997 | Lee | |
| 5,715,531 | A | 2/1998 | Liu et al. | |
| 6,084,485 | A * | 7/2000 | Bickford et al. | 333/26 |
| 6,236,289 | B1 * | 5/2001 | Slenker | 333/181 |
| 6,344,781 | B1 * | 2/2002 | Slenker | 333/181 |
| 6,509,821 | B1 | 1/2003 | Oldfield | |

* cited by examiner

*Primary Examiner*—Tuyen T Nguyen

(57) ABSTRACT

An integrated contact is disposed on the end of a conical coil form. Fine magnet wire is soldered to the integrated contact and wound around the coil form to fabricate a high-frequency inductor for use in high-frequency chokes and other high-frequency devices. In one embodiment, the integrated contact is plated on the tip of a polyiron coil form and less than one turn of wire is wrapped around the plated portion of the polyiron coil form. The integrated contact has reduced contact area, reducing capacitive coupling and improving high-frequency electrical performance.

13 Claims, 3 Drawing Sheets

HIGH-FREQUENCY INDUCTOR WITH INTEGRATED CONTACT

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to wound inductors for use in high-frequency circuits, and more specifically to a wide-band choke inductor wound around a tapered form.

BACKGROUND OF THE INVENTION

Active high-frequency devices, such as transistors and biased diodes, require a connection to a power supply to operate. The power supply is typically a direct-current ("DC") power supply, and the bias path from the power supply to the active high-frequency device should provide low impedance at DC, but very high impedance at the frequency of interest. The component used to establish the bias path from the power supply to the active high-frequency device is commonly called a high-frequency "choke."

An ideal high-frequency choke would consist of a single inductor that provided high impedance over all frequencies of interest. However, the equivalent circuit of a single inductor at high frequencies is a complex LRC circuit due to capacitances between individual turns of the coil and the presence of a surrounding enclosure, which are typically referred to as parasitic capacitances, and series resistance of the wire. This equivalent LRC circuit can have several resonant frequencies within the intended frequency range of use. At certain resonant frequencies, the inductor will appear as a low-impedance path loading the transmission line, resulting in large reflections and transmission loss.

Since simple inductors are not ideal high-frequency chokes, and may have relatively low self-resonate frequencies, they are often limited to narrow-band applications. Consequently, typical chokes may employ several series inductors along with resistors and capacitors to minimize the effect of the aforementioned parasitic capacitances.

Wide-band inductors for use in high-frequency chokes have been developed. One example uses fine, insulated wire wrapped in a conical fashion and the interior is filled with a ferromagnetic material, such as polyiron. In one instance, wire is wrapped around a tapered polyiron core. In another instance, a conical coil is wound around a mandrel, removed from the mandrel, and filled with polyiron-loaded epoxy, which hardens into a solid core. Polyiron is generally iron oxide powder mixed with various polymers to form a non-conductive solid material that is magnetically lossy at high frequencies. Polyiron is used to absorb electromagnetic waves in the frequency range of about 0.5 GHz to 120 GHz.

FIG. 1A shows a side view of a prior art conical inductor coil 10. A lead 12 extends from a narrow end 14 of the conical inductor coil 10 for connection to a microwave circuit (see FIG. 1C, ref. num. 24), and another lead 16 extends from a wide end 18 of the conical inductor coil 10 for connection to bias circuitry (not shown). Insulated magnet wire is typically used to wind the coil, and the ends of the leads 12, 16 are stripped of insulation and soldered to their respective circuits. It is desirable to keep the lead 12 as short as possible. If the lead 12 is too long, the high impedance of the inductor will be transformed (i.e. rotated) to a low-impedance contact at the soldering point and cause large reflections at certain frequencies; however, the lead 12 must be sufficiently long to allow soldering to the microwave circuit.

FIG. 1B shows an end view of the conical inductor coil 10 of FIG. 1A filled with polyiron 20. The polyiron 20 is a tapered core that the conical inductor coil 10 is wrapped around. Alternatively, the conical inductor coil is filled with a liquid resin-polyiron composition that cures to a solid polyiron core inside the conical inductor coil.

FIG. 1C shows a plan view of the conical inductor coil 10 of FIG. 1A electrically soldered to a microwave circuit 24, such as a microstrip circuit. Insulation has been removed from an end 12' of the lead 12, and the end 12' is electrically soldered to a center conductor 22 of the microstrip circuit 24 with solder 26.

In order to avoid the problems associated with the length of the lead 12 degrading electrical performance, conical inductor coils have been soldered in a through-hole of an air coaxial transmission line. The stripped end of wire from the narrow end of the conical inductor coil is inserted in the through-hole, and is soldered to the center conductor. Soldering the lead in the through-hole allows the length of the lead to be quite short compared to the end 12' of the lead 12 shown in FIG. 1C; however, air coaxial transmission lines are difficult to connect to many types of microwave devices, such as thin-film circuits and microwave integrated circuits, that are often included in hybrid microcircuits.

FIG. 2A shows an isometric side view of another prior art inductor coil assembly 30 with a metal end contact 32. A conical coil 34 of magnet wire is wound around a polyiron core 36. The metal end contact 32 is machined from brass or other metal and is pressed directly against the microwave circuit (not shown) with a spring (not shown), thus avoiding the problems arising from soldering the lead to the microwave circuit (see FIG. 1A–1C, ref. num. 12). Bias circuits with such inductor coil assemblies 30 are used in microwave chokes operating up to 50 GHz, and have been shipped in MODEL 8510 network analyzers, available from AGILENT TECHNOLOGIES, INC. of Palo Alto, Calif.

FIG. 2B shows an exploded view of portions of the inductor coil assembly 30 of FIG. 2A. The polyiron core 36 includes a tapered section 38 that the wire of the conical coil is wrapped around. The metal end contact 32 is joined to the polyiron core 36 with an insulator 40 of polyamide. A contact post 42 of the metal end contact 32 fits inside the insulator 40. An end of the wire (not shown) is soldered to the metal end contact 32 and wound around the polyiron core 36, including the portion of the contact post 42 that extends into the polyiron core 36.

Unfortunately, a few turns (typically 3–4) of the wire are wound around the contact post 42, which reduces the inductance of the coil and increases the capacitance of the inductor coil assembly 30 near its tip. Similarly, the metal end contact 32 is relatively large, allowing it to act as a microwave stub at a relatively low frequency, and the large contact area forms a capacitor between the metal end contact 32 and the ground plane of a microstrip circuit. This reduction of inductance and increase in capacitance reduces the self-resonant frequency and operating range of the inductor coil assembly 30.

BRIEF SUMMARY OF THE INVENTION

A tapered coil inductor is wound on a coil form having an integrated tip contact, enabling a broad-band inductor suitable for use in a high-frequency choke or other high-frequency application. In one embodiment, the inductor includes a coil form having a tip and a conical portion. An integrated contact is formed on the tip of the coil form. Inductor coil wire is soldered or otherwise electrically attached to the integrated contact, and an inductor coil is wound around the conical portion of the coil form. In a particular embodiment, the coil form is a polyiron coil form and the integrated contact is plated on the tip of the polyiron coil form. In a further embodiment, a plated portion of the coil form includes a groove for soldering an end of the inductor coil wire. In a particular embodiment, the inductor wire is wrapped around the plated portion of the coil form not more than one turn, whether or not the optional groove is included in the plated portion of the coil form.

In one embodiment, the narrow end of an inductor coil has an inside diameter of about 500 microns. The integrated contact has a radius of about 250 microns. These dimensions are particularly desirable when making an inductor for contacting to a 50-ohm transmission line on a fused silica substrate.

DETAILED DESCRIPTION OF THE EMBODIMENTS

I. Introduction

It was determined that inductors using a metal contact to touch a center conductor of a microstrip transmission line perform better in high-frequency chokes than inductors that are bonded or connected with solder. The present invention provides an improved inductor assembly with superior performance at high frequencies using a coil form with an integrated electrical contact at the tip of the coil form.

Figure 3A:
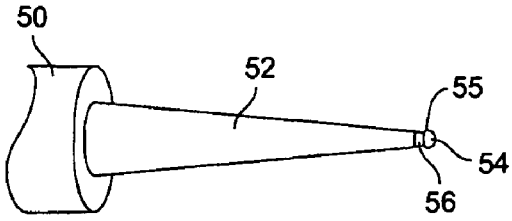
FIG. 3A shows a coil form according to an embodiment of the present invention.

FIG. 3A shows a coil form 50 according to an embodiment of the present invention. The coil form 50 is fabricated from polyiron, such as MF-124™ or MF-500-124™ available from EMMERSON & CUMING, MICROWAVE PRODUCTS, of Randolph, Mass. Alternatively, the coil form is fabricated from a dielectric material that does not substantially absorb electromagnetic waves at RF, microwave, and millimeter-wave frequencies, or is fabricated from a polymer, such as epoxy, loaded with ferrite material other than polyiron.

A conical portion 52 of the coil form 50 has a tip 54 that is plated with metal to form an integrated electrical contact. The tip 54 is very fine and plating provides a conductive tip surface without substantially increasing the contact area of the tip to the microcircuit (i.e. without substantially increasing the radius of the tip). The tip 54 includes a groove 56 to which an end of wire (not shown) is soldered. The groove facilitates proper placement of the first turn of wire, the end of which is soldered to the plated groove, and supports the first turn of wire to keep the wire coil from slipping off the coil form when the wire is wound. The wire is then wrapped around the conical portion 52, typically from the tip back toward the wider portion of the coil, to form an inductor coil. In one embodiment, 36-guage copper magnet wire rated for 155° C. to 250° C. is used to wind the inductor coil, which provides sufficiently low resistance at DC and a sufficient number of turns to provide high impedance at high frequencies. Typically, less than one turn of wire is wound around the tip 54 to avoid high-frequency coupling between adjacent turns of wire through the conductive plated section that would otherwise occur. The other turns of wire are wound around the non-conductive, conical portion 52 of the coil form 50.

Figure 3B:
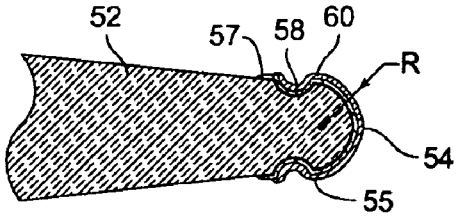
FIG. 3B shows a cross section of the tip portion of the coil form shown in FIG. 3A.

FIG. 3B shows a cross section of the tip 54 of the coil form 50 shown in FIG. 3A. The thicknesses of the plated layers are exaggerated for purposes of illustration. A very thin layer of palladium-gold is sputtered onto the coil form 50. This sputtered layer is estimated to be about 1000 Angstroms thick, and is not shown. A thin layer of gold, about 10–15 micro-inches thick 57 is plated on the sputtered palladium-gold. A layer of nickel 58 is plated over the thin layer of gold, and a relatively thick layer of gold 60 is plated over the nickel layer 58.

The sputtered layer of palladium-gold acts as a seed layer that facilitates subsequent plating. The thin layer of gold acts as a barrier layer to protect the polyiron coil form 50 from a nickel stripping solution used later in the process. The nickel layer 58 provides good adhesion to the polyiron coil form 50, and the gold layer 60 provides good solderability and low contact resistance. Alternatively, other plating systems or metallizing techniques are used.

After plating the coil form 50, the tip 54 is masked off and the plated coil form is submersed in gold stripping solution to remove the gold layer 60 from the remainder of the coil form 50. Next, the partially plated coil form is submersed in nickel stripping solution to remove the nickel layer 58 from the remainder of the coil form 50. The thin layer of gold protects the polyiron coil form 50 from the nickel stripping solution, which would otherwise attack the polyiron. The gold stripping solution does not attack the polyiron, and after the nickel layer 58 is stripped, the coil form 50 is submersed in gold stripping solution again to remove the thin (barrier)

layer of gold and sputtered palladium-gold layer. The masking is removed from the tip 54, leaving the tip plated with gold-nickel-gold layers.

Figure 1A:
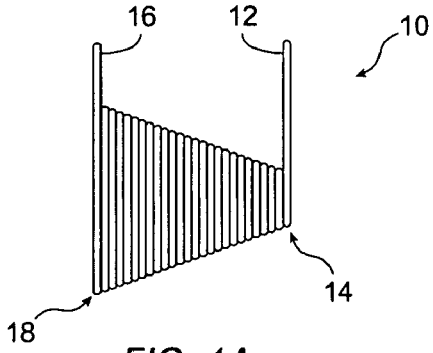
FIG. 1A (PRIOR ART)
FIG. 1A shows a side view of a prior art tapered inductor coil.
Figure 1B:
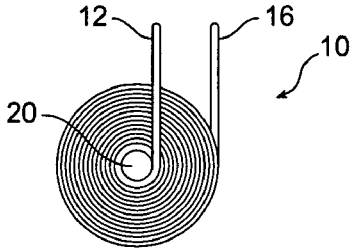
FIG. 1B (PRIOR ART)
FIG. 1B shows an end view of the prior art tapered inductor coil of FIG. 1A.
Figure 1C:
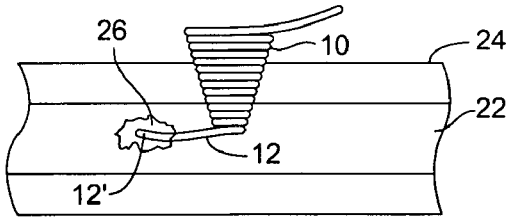
FIG. 1C (PRIOR ART)
FIG. 1C shows a plan view of the conical inductor coil of FIGS. 1A and 1B electrically coupled to a microwave circuit.
Figure 2A:
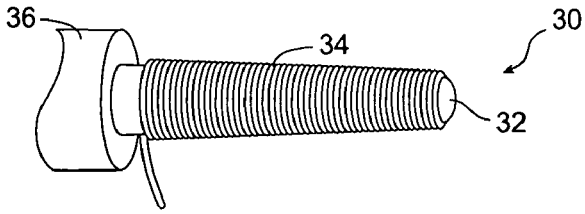
FIG. 2A (PRIOR ART)
FIG. 2A shows an isometric side view of a prior art bias coil with a metal end contact.
Figure 2B:
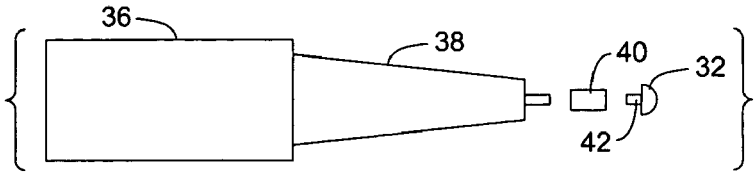
FIG. 2B (PRIOR ART)
FIG. 2B shows an exploded view of portions of the inductor coil assembly 30 of FIG. 2A.

Plating the tip 54 creates an integrated electrical contact 55 without a contact post that multiple turns of wire are wrapped around (see FIG. 2B, ref. num. 42), and with a contact area that is greatly reduced from the contact area of the machined metal end contact (see FIG. 2B, ref. num. 32). The mass of metal is also greatly reduced, decreasing the likelihood that the tip will act as a stub, and the surface area of the metal of the tip 54 is also greatly reduced, decreasing capacitive coupling with the ground plane and surrounding enclosure (package) of a microstrip circuit, compared to the metal end contact 32.

The integrated contact 55 has a radius R of about 225–250 microns. In comparison, the machined metal end contact 32 of the inductor coil assembly 30 shown in FIG. 2A has a radius of about 750 microns. An integrated contact with a tip radius of about 250 microns or less is particularly desirable when making contact to microstrip circuits fabricated on fused silica substrates because the width of the center conductor of a 50-ohm transmission line is about 500 microns. A larger contact area is more likely to overhang the center conductor, which increases the capacitance with the ground plane of the circuit and degrades electrical performance.

Figure 4A:
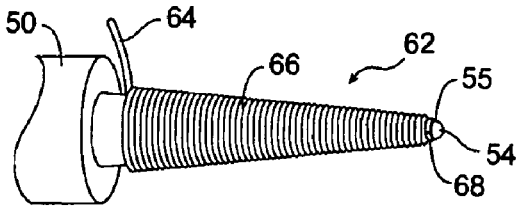
FIG. 4A shows a side view of an inductor coil assembly according to an embodiment of the present invention.

FIG. 4A shows a side view of an inductor coil assembly 62 according to an embodiment of the present invention. The tip 54 was selectively plated on the coil form 50, and wire 64 was soldered to the plated tip 54. A conical inductor coil 66 was wound around the coil form 50 starting from the tip 54 using a coil-winding machine. The coil form was made of polyiron. A small amount of adhesive was spread over the windings of the conical inductor coil 66 to prevent the coil from unwinding when the inductor coil assembly 62 was removed from the coil-winding machine. In a particular embodiment, a narrow end 68 of the conical inductor coil 66 has an inside diameter, and the outside diameter of the integrated contact 55 of the tip 54 is about equal to the inside diameter. In other words, the metal of the integrated contact does not extend outside of the narrow end 68 of the conical inductor coil 66.

Figure 4B:
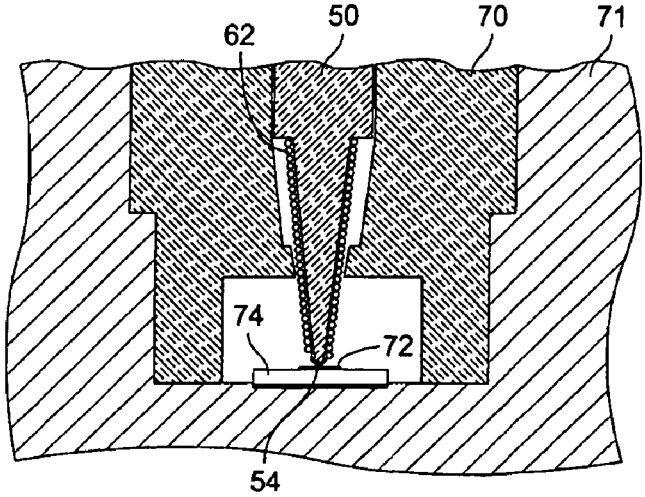
FIG. 4B shows cross-section of the inductor coil assembly of FIG. 4A in a bias-T according to an embodiment of the present invention.

FIG. 4B shows an oblique cut-away view of the inductor coil assembly 62 of FIG. 4A in a bias-T according to an embodiment of the present invention. A polyiron holder 70 in a microcircuit package 71 positions the inductor coil assembly 62 over a center conductor 72 of a microstrip circuit 74. The tip 54 of the integrated contact is held against the center conductor 72 with a spring (not shown) that firmly presses the tip 54 against center conductor 72 when a cover (not shown) is installed on the microcircuit package 71.

Figure 5:
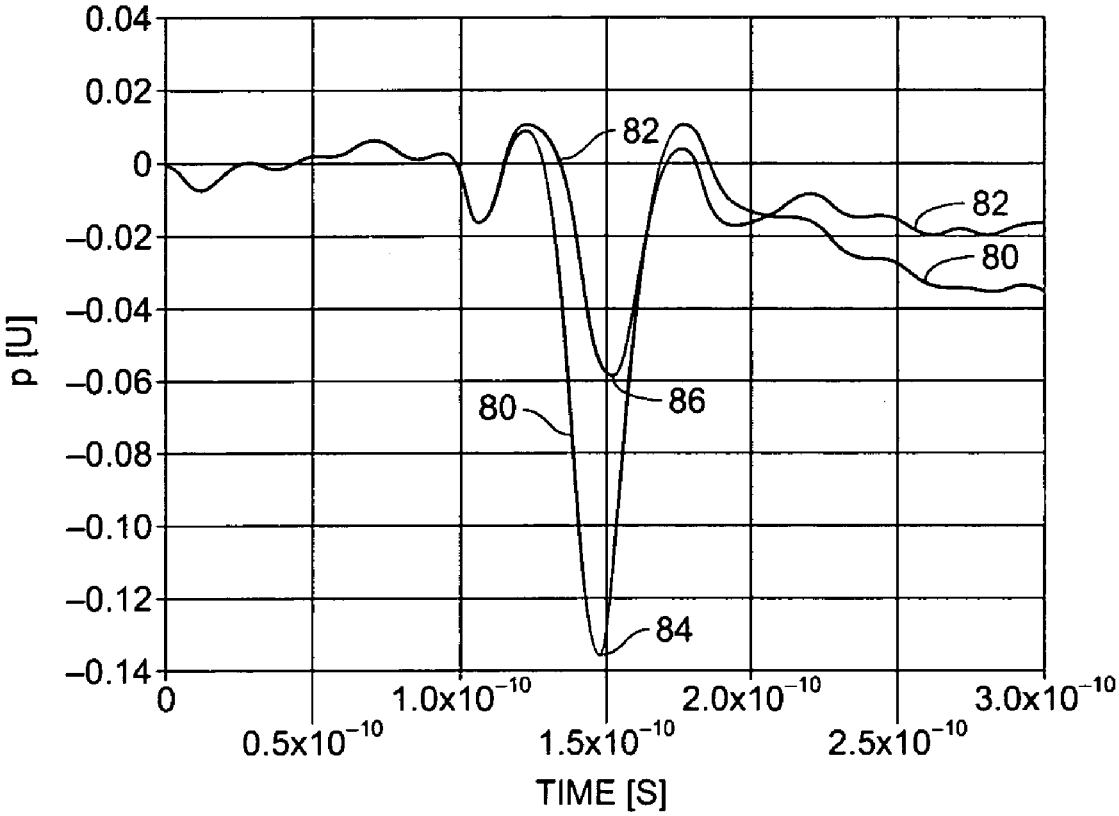
FIG. 5 is a graph showing the time-domain port reflectivity of a 50-ohm microstrip transmission line contacted with the prior art inductor coil assembly of FIG. 2A and the time-domain port reflectivity of the 50-ohm microstrip transmission line with the inductor coil assembly of FIG. 4A.

FIG. 5 is a graph showing time-domain port reflection coefficient 80 of a 50-ohm microstrip transmission line in a bias-T electrically coupled to the prior art inductor coil assembly 30 of FIG. 2A, and time-domain port reflectivity 82 of a 50-ohm microstrip transmission line electrically coupled to the inductor coil assembly 62 of FIG. 4A. Dips 84, 86 in the time-domain port reflection data indicate that shunt capacitance is loading the microstrip line. Comparing the dip 84 of the prior art inductor coil assembly 30 to the dip 86 of the inductor coil assembly 30 according to an embodiment of the present invention shows that loading of the microstrip line is significantly reduced with the inductor coil assembly 62 according to an embodiment of the present invention.

While the preferred embodiments of the present invention have been illustrated in detail, it should be apparent that modifications and adaptations to these embodiments might occur to one skilled in the art without departing from the scope of the present invention as set forth in the following claims.

What is claimed is:

1. An inductor comprising:

a coil form having a conical portion with a tip;

an integrated contact comprising a plated tip portion disposed on the tip of the coil form comprising a first gold layer, a nickel layer disposed on the first gold layer, and a second gold layer disposed on the nickel layer; and an inductor coil wound around the coil form and electrically coupled to the integrated contact.

2. The inductor of claim 1 wherein the coil form comprises polyiron.

3. An inductor comprising:

a polyiron coil form having a conical portion with a tip;

an integrated contact disposed on the tip of the polyiron coil form comprising a plated tip portion;

an inductor coil wound around the polyiron coil form and electrically coupled to the plated tip portion; and a groove in the plated tip portion of the polyiron coil form.

4. The inductor of claim 3 wherein an end of the inductor coil is soldered to the plated tip portion of the polyiron coil form.

5. The inductor of claim 4 wherein the inductor coil is wound not more than one turn around the plated tip portion of the polyiron coil form.

6. The inductor of claim 3 wherein the inductor coil has a narrow end with an inside diameter, an outside diameter of the integrated contact being essentially equal to the inside diameter of the narrow end of the inductor coil.

7. The inductor of claim 3 wherein the integrated contact has a hemispherical radius not greater than 250 microns.

8. An inductor comprising:

a polyiron coil form having a conical portion and a plated tip portion comprising a gold barrier layer proximate to the polyiron coil form, a nickel layer disposed on the gold barrier layer, and a gold layer disposed on the nickel layer; and an inductor coil wound around the conical portion of the coil form wherein an end of the inductor coil is soldered to the plated tip portion.

9. An inductor comprising:

a polyiron coil form having a conical portion and a plated tip portion;

an inductor coil wound around the conical portion of the coil form; and a groove in the plated tip portion of the polyiron coil form, the end of the inductor coil being soldered in the groove of the plated tip portion.

10. The inductor of claim 9 wherein the inductor coil is wound not more than one turn around the plated tip portion of the polyiron coil form.

11. The inductor of claim 9 wherein the plated tip portion has a hemispherical radius not greater than 250 microns.

12. An inductor comprising:

a polyiron coil form having a conical portion and a plated tip portion with a groove; and an inductor coil wound around the conical portion of the coil form, and end of the inductor coil being soldered to in the groove of the plated tip portion, wherein the inductor coil is wound not more than one turn around the plated portion of the coil form.

13. The inductor of claim 12 wherein the plated tip portion has a radius not greater than 250 microns.

* * * * *